US005879790A

United States Patent [19]

Sogabe et al.

[11] Patent Number: 5,879,790

[45] Date of Patent: Mar. 9, 1999

[54] THERMAL TRANSFER RECORDING MEDIUM

[75] Inventors: Jun Sogabe; Eiichi Ueda, both of Osaka, Japan

[73] Assignee: Fujicopian Co., Ltd., Osaka, Japan

[21] Appl. No.: 611,450

[22] Filed: Mar. 5, 1996

[30] Foreign Application Priority Data

Mar. 6, 1995 [JP] Japan ..... 7-045744

[51] Int. Cl.[6] ..... B41M 5/26

[52] U.S. Cl. ..... 428/213; 428/195; 428/215; 428/216; 428/323; 428/913; 428/914

[58] Field of Search ..... 428/327–332, 428/195, 207, 212, 500, 484, 488.1, 213, 215, 216, 323, 913, 914

[56] References Cited

U.S. PATENT DOCUMENTS 5,130,180 7/1992 Koshizuka et al. ..... 428/212
5,279,884 1/1994 Kitamura et al. ..... 428/195

FOREIGN PATENT DOCUMENTS 0 568 031 A1 11/1993 European Pat. Off. ..... B41M 5/00
A-03-051184 3/1991 Japan ..... B41M 5/30
A-03-178488 8/1991 Japan ..... B41M 5/40

OTHER PUBLICATIONS

*Patent Abstracts of Japan,* vol. 15, No. 422 (M–1173), published Oct. 25, 1991, citing Japanese patent application JP–A–03–178488, published Aug. 2, 1991.

*Patent Abstracts of Japan,* vol. 15, No. 194 (M–1114), published May 20, 1991, citing Japanese patent application JP–A–03–051184, published Mar. 5, 1991.

*Primary Examiner*—Pamela R. Schwartz
*Attorney, Agent, or Firm*—Fish & Neave

[57] ABSTRACT

A thermal transfer recording medium is provided which comprises: a foundation; a release layer; a fine-particle-containing layer containing a binder comprising a heat-meltable resin as a principal component thereof and fine particles dispersed therein; and a color ink layer containing a binder comprising a heat-meltable resin as a principal component thereof; the release layer, the fine-particle-containing layer and the color ink layer being provided on one side of the foundation in this order.

5 Claims, 2 Drawing Sheets

THERMAL TRANSFER RECORDING MEDIUM

BACKGROUND OF THE INVENTION

The present invention relates to a thermal transfer recording medium for use with a word processor, printer, facsimile, bar-code printer or the like and, more particularly, to a thermal transfer recording medium which allows a high-precision print image to be transferred onto a paper sheet having a low surface smoothness (hereinafter referred to as "rough paper sheet").

A conventional thermal transfer recording medium allowing for high-quality printing on a rough paper sheet (hereinafter referred to as "thermal transfer recording medium for rough paper") comprises a foundation, a release layer formed on a foundation including a wax as a principal component thereof, and a color ink layer formed on the release layer containing a coloring agent dispersed in a binder with a high melt viscosity including a resin as a principal component thereof.

When an image is printed on a rough paper sheet with such a thermal transfer recording medium, a portion of the color ink layer is transferred onto the rough paper sheet in such a state that the transferred portion bridges troughs of a microscopically undulated surface of the rough paper sheet. However, the high viscosity of the binder leads to less sharp separation of the color ink layer in printing.

To overcome this problem, the addition of fine particles to a color ink layer has been proposed. In a. thermal transfer recording medium including such a color ink layer, the fine particles contained in the color layer exist adjacent to a surface of the color ink layer as shown in FIG. 3 (which is a schematic sectional view of a conventional thermal transfer recording medium), and some of the fine particles partially project from the surface of the color ink layer. When an image is printed on a rough paper sheet with the thermal transfer recording medium, the fine particles partially projecting from the surface of the color ink layer prevent the image from sufficiently adhering onto the rough paper sheet. This results in a failure in image transfer, thereby preventing the printing of a high-precision image.

In view of the foregoing problems, it is an object of the present invention to provide a thermal transfer recording medium which allows for high-quality printing without degrading ink transfer performance to form a high-precision print image even on a rough paper sheet.

The foregoing and other objects of the present invention will be apparent from the following detailed description.

SUMMARY OF THE INVENTION

In accordance with a first aspect of the present invention, there is provided a thermal transfer recording medium comprising: a foundation; a release layer; a fine-particle-containing layer containing a binder comprising a heat-meltable resin as a principal component thereof and fine particles dispersed therein; and a color ink layer containing a binder comprising a heat-meltable resin as a principal component thereof; the release layer, the fine-particle-containing layer and the color ink layer being provided on one side of the foundation in this order.

In accordance with a second aspect of the present invention, the thermal transfer recording medium is characterized in that a relationship between the thickness m ($\mu$m) of the fine-particle-containing layer, the average diameter r ($\mu$m) of the fine particles and the thickness n ($\mu$m) of the color ink layer is represented as $n \geqq r \geqq m$.

The thickness of the fine-particle-containing layer herein represents the thickness of a portion thereof where fine particles partially projecting therefrom into the color ink layer are not present, as shown in FIG. 1. Similarly, the thickness of the color ink layer herein represents the thickness of a portion thereof where fine particles partially projecting thereinto from the fine-particle-containing layer are not present, as shown in FIG. 1. The thickness m of the fine-particle-containing layer and the thickness n of the color ink layer are clearly defined in FIG. 1.

The thickness of each of the fine-particle-containing layer and the color ink layer is herein determined by taking a photograph of a section of the thermal transfer recording medium at a magnification of ×10,000 under a scanning electron microscope (JSM-T-330A available from JEOL LTD.), and averaging measurements of the thickness obtained at five different points located at intervals of 1 $\mu$m. It should be noted that a portion of the fine-particle-containing layer where fine particles partially projecting therefrom are present is not counted in the measurement of the thickness of the fine-particle-containing layer, and that a portion of the color ink layer where fine particles project thereinto from the fine-particle-containing layer are present is not counted in the measurement of the thickness of the color ink layer.

With use of the thermal transfer recording medium of the first aspect of the present invention which comprises: a foundation; a release layer; a fine-particle-containing layer containing a binder comprising a heat-meltable resin as a principal component thereof and fine particles dispersed therein; and a color ink layer containing a binder comprising a heat-meltable resin as a principal component thereof; wherein the release layer, the fine-particle-containing layer and the color ink layer are formed on one side of the foundation in this order, a heated portion of the color ink layer can be sharply separated from the other portion of the color ink layer and transferred even onto a rough paper sheet as an image receptor in such a state that the transferred portion properly bridges troughs of a microscopically undulated surface of the rough paper sheet. Thus, a high-precision image can be obtained.

With use of the thermal transfer recording medium of the second aspect of the present invention characterized in that a relationship between the thickness m ($\mu$m) of the fine-particle-containing layer, the average diameter r ($\mu$m) of the fine particles and the thickness n ($\mu$m ) of the color ink layer is represented as $n \geqq r \geqq m$, the separation of the color ink layer can be further improved, and a high-precision image can be more favorably printed even on a rough paper sheet as an image receptor.

DETAILED DESCRIPTION

A thermal transfer recording medium according to the present invention will hereinafter be described with reference to the attached drawings.

Figure 1:
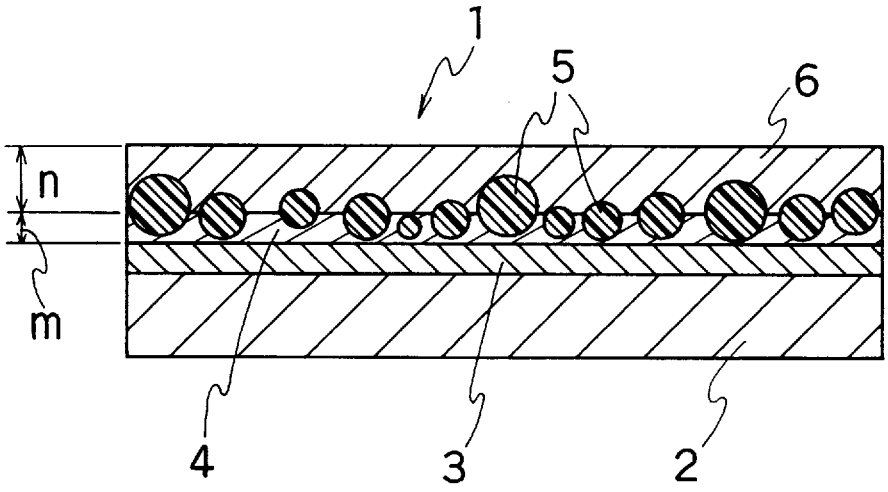
FIG. 1 is a schematic partial sectional view illustrating a thermal transfer recording medium according to an embodiment of the present invention.

FIG. 1 is a schematic partial sectional view illustrating a thermal transfer recording medium according to an embodiment of the present invention. In FIG. 1, there are shown the thermal transfer recording medium 1, a foundation 2, a release layer 3, a fine-particle-containing layer 4, fine particles 5, and a color ink layer 6.

The fine-particle-containing layer 4 includes the fine particles 5 dispersed in a binder including a heat-meltable resin as a principal component thereof.

It is required that preferably about not less than half the number of the fine particles 5 partially project from a surface of the fine-particle-containing layer 4 to intrude into the color ink layer 6 as shown in FIG. 1. To satisfy this requirement, fine particles having diameters greater than the thickness of the fine-particle-containing layer 4 are to be included in the fine-particle-containing layer. To allow portions of the fine particles 5 to sufficiently project from the surface of the fine-particle-containing layer 4, the fine particles 5 preferably have an average diameter r not smaller than the thickness m of the fine-particle-containing layer 4.

The fracture strength of the color ink layer 6 is reduced by allowing the portions of the fine-particles to project into the color ink layer 6 from the surface of the fine-particle-containing layer. The strength of the color ink layer in an unheated state is greatly reduced by the fine particles partially projecting into the color ink layer 6. Therefore, the heated portion of the color ink layer can be sharply separated from the unheated portion, so that a high-precision printing can be realized.

If the diameter of the fine particles 5 is excessively large, the fine particles project through the color ink layer 6, thereby reducing the adhesion of the color ink layer onto a rough paper. Therefore, the average diameter r of the fine particles 5 is preferably not larger than the thickness n of the color ink layer 6.

The fine particles 5 may comprise are particles of organic materials and of inorganic materials. Examples of specific organic materials include styrene resins, methacrylate resins, acrylate resins, melamine resins, benzoguanamine resins, starch and cellulose. Examples of specific inorganic materials include silica, alumina and diatom earth, and various inorganic pigments. These organic and inorganic material particles may be used either alone or in combination as the fine particles 5.

As described above, the average diameter r of the fine particles 5 is preferably not smaller than the thickness m of the fine-particle-containing layer 4, and may generally be within a range between 0.3 $\mu$m and 10.0 $\mu$m, preferably within a range between 0.3 $\mu$m and 3.0 $\mu$m . If the average diameter r of the fine particles is greater than the aforesaid range, a need arises to increase the thickness of the color ink layer, thereby degrading the transfer sensitivity of the resulting thermal transfer recording medium. On the other hand, if the average diameter r is less than the aforesaid range, a desired separation sharpness of the color ink layer may not be obtained.

The fine particles are preferably spherical, but may be of a needle shape, a plate shape or a rod shape. Where fine particles to be used are of any shape other than spherical shape, the diameter of such a fine particle denotes the longest portion of the particle.

The binder for the fine-particle-containing layer 4 includes a heat-meltable resin and, as required, a wax blended therewith. The content of the heat-meltable resin in the binder is preferably not less than 80% by weight, more preferably not less than 90% by weight.

Examples of specific heat-meltable resins to be used for the binder for the fine-particle-containing layer include resins including olefinic copolymers such as ethylene-vinyl acetate copolymer and ethylene-acrylic ester copolymer, polyamide resins, polyester resins, epoxy resins, polyurethane resins, acrylic resins, vinyl chloride resins, cellulosic resins, vinyl alcohol resins, petroleum resins, phenol resins, styrene resins and vinyl acetate resins, and elastomers such as natural rubbers, styrene-butadiene rubber, isoprene rubber and chloroprene rubber. These may be used either alone or in combination.

Examples of specific waxes to be optionally blended with the heat-meltable resin for the binder for the fine-particle-containing layer include: natural waxes such as haze wax, bees wax, carnauba wax, candelilla wax, montan wax and ceresine wax; petroleum waxes such as paraffin wax and microcrystalline wax; synthetic waxes such as oxidized waxes, ester waxes, polyethylene wax, Fischer-Tropsch wax and $\alpha$-olefin-maleic anhydride copolymer wax; and higher fatty acids such as myristic acid, palmitic acid, stearic acid and behenic acid. These waxes may be used either alone or in combination.

The heat-meltable resin and the wax to be optionally added are dissolved in an appropriate solvent, and the fine particles are dispersed therein to prepare a coating liquid for the fine-particle-containing layer.

The coating liquid is applied on the release layer 3 and dried for the formation of the fine-particle-containing layer.

The content of the fine particles in the fine-particle-containing layer is preferably within a range between 5%. and 80% by weight, more preferably within a range between 10% and 40% by weight. If the content of the fine particles is less than the aforesaid range, an intended effect may not be obtained. On the other hand, if the content is greater than the aforesaid range, a normal coating film may not be formed.

Examples of specific solvents to be used for the preparation of the coating liquid include toluene, methyl ethyl ketone, methyl isobutyl ketone, tetrahydrofuran, isopropyl alcohol, methylene chloride, xylene and methanol.

The thickness of the fine-particle-containing layer is preferably within a range between 0.2 $\mu$m and 3.0 $\mu$m, more preferably between 0.2 $\mu$m and 1.0 $\mu$m. If the thickness of the fine-particle-containing layer is greater than the aforesaid range, an insufficient sensitivity may result. On the other hand, if the thickness is less than the aforesaid range, an intended effect may not be obtained.

The foundation 2 may comprise any material capable of withstanding heat applied at thermal transfer. Examples thereof include polyester films such as polyethylene terephthalate film and polyethylene naphthalate film, polycarbonate films, polyamide films, aramid films and other various plastic films commonly used for the foundation of ink ribbons of this type. Thin paper sheets of high density such as condenser paper can otherwise be used. The thickness of the foundation is preferably about 1 $\mu$m to about 10 $\mu$m, more preferably about 2 $\mu$m to about 7 $\mu$m to ensure excellent thermal conductivity.

Where any of the aforesaid plastic films is used as the foundation, a conventionally known stick-preventive layer may be formed on the back side (the side adapted to come into slide contact with a thermal head) of the foundation. Examples of the materials for the stick-preventive layer include various heat-resistant resins such as silicone resin, fluorine-containing resins and nitrocellulose resin, and other resins modified with these heat-resistant resins such as silicone-modified urethane resins, and mixtures of the foregoing heat-resistant resins and lubricating agents.

The release layer 3 contains a heat-meltable material including a wax as a principal component and, as required, a heat-meltable resin may be blended therewith.

Examples of specific waxes to be used for the release layer include: natural waxes such as haze wax, bees wax, carnauba wax, candelilla wax, montan wax and ceresine wax; petroleum waxes such as paraffin wax and microcrystalline wax; synthetic waxes such as oxidized waxes, ester waxes, polyethylene wax, Fischer-Tropsch wax and α-olefin-maleic anhydride copolymer wax; higher fatty acids such as myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as stearic acid amide and oleic acid amide. These waxes may be used either alone or in combination.

Examples of specific heat-meltable resins (including elastomers) to be optionally blended with the wax for the release layer include olefinic copolymers such as ethylene-vinyl acetate copolymer and ethylene-acrylic ester copolymer, polyamide resins, polyester resins, epoxy resins, polyurethane resins, acrylic resins, vinyl chloride resins, cellulosic resins, vinyl alcohol resins, petroleum resins, phenol resins, styrene resins, vinyl acetate resins, natural rubbers, styrene-butadiene rubber, isoprene rubber, chloroprene rubber, polyisobutylene and polybutene. These may be used either alone or in combination.

The content of the wax in the release layer is preferably not less than 80% by weight, and the content of the heat-meltable resin to be optionally added is preferably not greater than 20% by weight.

The wax and the heat-meltable resin to be optionally added are applied on the foundation in a form of a solution, dispersion or emulsion, and dried to form the release layer. The coating amount (on the basis of dried amount, hereinafter the same) for the release layer is preferably about 0.2 $g/m^2$ to about 1.5 $g/m^2$.

The color ink layer 6 contains a coloring agent and a binder including a heat-meltable resin as a principal component thereof.

The heat-meltable resin to be used for the color ink layer preferably has a melt index of not higher than 2500/190° C., more preferably not higher than 1100/190° C.

If the melt index is higher than 2500/190° C., the printability on a rough paper may be degraded. If the melt index is excessively low, such an inconvenience as a reduced dispersibility of the coloring agent may result.

Therefore, the melt index is preferably not lower than 15/190° C .

The binder preferably includes a heat-meltable resin preferably having a melt index of not higher than 2500/190° C. (more preferably 1100/190° C. ) in an amount of not less than 70% by weight. If the content of the eat-meltable resin is less than 70% by weight, the printability on rough paper may be degraded. A wax may be added to the binder as required, and the content thereof is preferably not greater than 10% by weight.

Examples of specific heat-meltable resins including elastomers) to be used for the binder for the color ink layer include olefinic copolymers such as ethylene-vinyl acetate copolymer and ethylene-acrylic ester copolymer, polyamide resins, polyester resins, epoxy resins, polyurethane resins, acrylic resins, vinyl chloride resins, cellulosic resins, vinyl alcohol resins, petroleum resins, phenol resins, styrene resins, vinyl acetate resins, natural rubbers, styrene-butadiene rubber, isoprene rubber, chloroprene rubber, polyisobutylene and polybutene. These may be used either alone or in combination to satisfy the aforesaid requirement for the melt index.

Examples of specific waxes to be optionally blended with the heat-meltable resin for the color ink layer include: natural waxes such as haze wax, bees wax, carnauba wax, candelilla wax, montan wax and ceresine wax; petroleum waxes such as paraffin wax and microcrystalline wax; synthetic waxes such as oxidized waxes, ester waxes, polyethylene wax, Fischer-Tropsch wax and α-olefin-maleic anhydride copolymer wax; higher fatty acids such as myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as stearic acid amide and oleic acid amide. These waxes may be used either alone or in combination.

As the coloring agent for the color ink layer, carbon black as well as various organic and inorganic pigments may be used. The content of the coloring agent in the color ink layer is preferably about 10% to about 30% by weight.

The heat-meltable resin and the wax to be optionally added are dissolved in an appropriate solvent, and the coloring agent is dispersed therein to prepare a coating liquid for the color ink layer. The coating liquid is applied on the fine-particle-containing layer and dried for the formation of the color ink layer. The thickness of the color ink layer is preferably 1.0 μm to 3.0 μm from the viewpoint of ensuring desired image density and transfer sensitivity.

Figure 2:
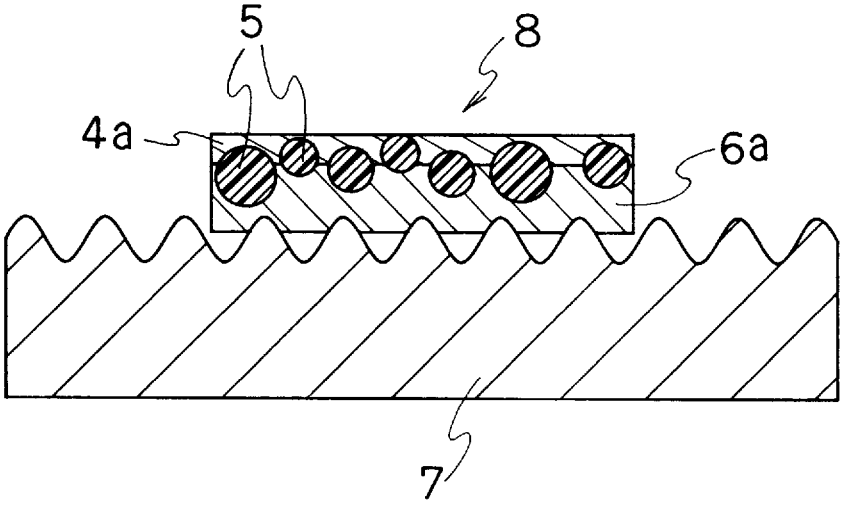
FIG. 2 is a diagram for explaining a state of a print image transferred on a rough paper with use of the thermal transfer recording medium of the present invention.
Figure 3:
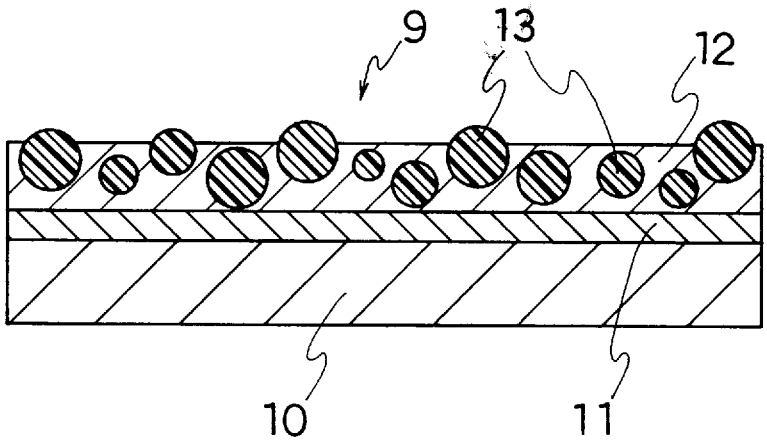
FIG. 3 is a schematic partial sectional view illustrating a conventional thermal transfer recording medium.
Figure 4:
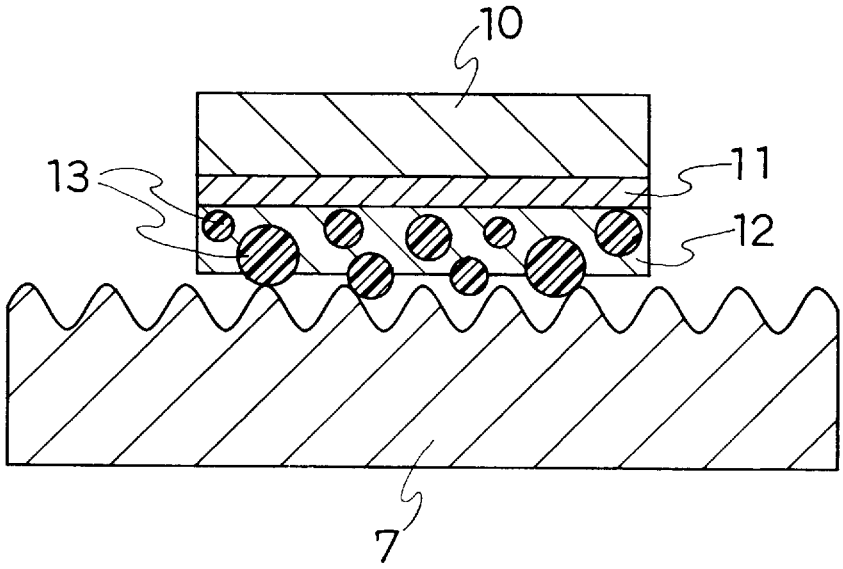
FIG. 4 is a diagram for explaining an undesirable state of a print image transferred on a rough paper with use of the conventional thermal transfer recording medium.

The state of a print image transferred on rough paper with use of the thermal transfer recording medium of the present invention is shown in a schematic partial sectional view of FIG. 2. In FIG. 2, there are shown a rough paper sheet 7, a print image 8 transferred onto the rough paper sheet, a transferred fine-particle-containing layer 4*a*, a transferred color ink layer 6*a* and fine particles 5. The print image transferred onto the rough paper has no fine particles projecting to the side of the rough paper and a smooth surface facing opposite the rough paper. Therefore, the adhesion of the print image onto the rough paper is improved.

The present invention will be more fully described by way of examples and comparative examples thereof. It is to be understood that the present invention is not limited to these examples, and various changes and modifications may be made in the invention without departing from the spirit and scope thereof.

Examples 1 to 3 and Comparative Examples 1 and 2

An aqueous emulsion of paraffin wax (m.p. 75° C.) was applied on a surface of a 3.5 μm-thick polyethylene terephthalate film formed with a 0.1 μm-thick silicone resin stick-preventive layer on the back side thereof, and dried at 60° C. Thus, a release layer having a coating amount of 1.0 $g/m^2$ was formed.

Fine-particle-containing ink coating liquids respectively having compositions as shown in Table 1 were prepared, and each applied on the aforesaid release layer and dried at 60° C. Thus, a fine-particle-containing layer having a coating amount of 0.5 $g/m^2$ was formed. The thickness of the fine-particle-containing layer was 0.5 μm. In Comparative Examples 1 and 2, no fine-particle-containing layer was formed.

Color ink coating liquids respectively having compositions as shown in Table 1 were prepared, and each applied on the fine-particle-containing layer and dried at 60° C. Thus, a color ink layer having a coating amount of 1.5 g/m$^2$ was formed. The thickness of the color ink layer was 1.5 $\mu$m.

The respective thermal transfer recording media thus obtained were slit into a width of 12.7 mm and wound around cores for preparation of ribbon rolls. Each of the ribbon rolls was accommodated in a cassette, which was set in a thermal transfer printer (U1P95 available from Matsushita Electric Industrial Co., Ltd.). Then, the printability (dot reproducibility) of each of the thermal transfer recording media was evaluated by performing a printing operation under the following printing conditions.

Printing energy: Max. (a value specified for the printer)

Printing speed: 100 cps

Receptor sheet: XEROX #4024 (Available from Xerox, Bekk smoothness: 28 sec)

Dots were printed at intervals of two dots in an area of 1 cm×1 cm, and the printed dot image was observed at a magnification of ×30 under an optical microscope. Transfer rates of the respective thermal transfer recording media were calculated from the following equation, and evaluated on the following criteria. The results are shown in Table 1.

Transfer rate (%)=(Number of transferred dots/Number of dots to be transferred)×100

Criteria

3: Transfer rate of not lower than 90%

2: Transfer rate of not lower than 70% but lower than 90%

1: Transfer rate of lower than 70%

The evaluation value "3" indicates that the dot reproducibility was excellent, and the evaluation value "2" indicates that the dot reproducibility was acceptable for practical use.

TABLE 1

| | Example 1 | Example 2 | Example 3 | Comparative Example 1 | Comparative Example 2 |
|---|---|---|---|---|---|
| Fine-particle-containing ink (parts by weight) | | | | | |
| Hydrogenated alicyclic resin | 9 | 9 | 9 | — | — |
| EVA *1 | 3 | 3 | 3 | — | — |
| Melamine resin particles (I) *2 | 3 | — | — | — | — |
| $SiO_2$ particles (II) *3 | — | — | 3 | — | — |
| $SiO_2$ particles (III) *4 | — | 3 | — | — | — |
| Toluene | 25 | 25 | 25 | — | — |
| Methyl ethyl ketone | 60 | 60 | 60 | — | — |
| Color ink (parts by weight) | | | | | |
| EVA *1 | 80 | 80 | 80 | 80 | 60 |
| Carbon black | 20 | 20 | 20 | 20 | 20 |
| $SiO_2$ particles (III) *4 | — | — | — | — | 20 |
| Toluene | 400 | 400 | 400 | 400 | 400 |
| Evaluation | | | | | |
| Dot reproducibility | 3 | 3 | 2 | 1 | 1 |

*1 Ethylene-vinyl acetate copolymer (melt index: 400)

*2 Melamine resin particles having an average diameter of 0.5 $\mu$m

*3 $SiO_2$ particles having an average diameter of 2.0 $\mu$m

*4 $SiO_2$ particles having an average diameter of 1.0 $\mu$m

In Example 3, the evaluation value of the dot reproducibility was "2", because the average diameter of the fine particles was equal to the sum of the thickness of the fine-particle-containing layer and the thickness of the color ink layer. In Comparative Examples 1 and 2, a desired dot reproducibility could not be obtained, because no fine-particle-containing layer was provided.

In accordance with the present invention, with use of a thermal transfer recording medium comprising: a foundation; a release layer; a fine-particle-containing layer containing a binder comprising a heat-meltable resin as a principal component thereof and fine particles dispersed therein; and a color ink layer containing a binder comprising a heat-meltable resin as a principal component thereof; wherein the release layer, the fineparticle-containing layer and the color ink layer are formed on one side of the foundation in this order, a heated portion of the color ink layer can be sharply separated from the unheated portion of the color ink layer and transferred even onto a rough paper sheet as an image receptor in such a state that the transferred portion properly bridges troughs of a microscopically undulated surface of the rough paper sheet. Thus, a high-precision image can be obtained.

With use of a thermal transfer recording medium characterized in that a relationship between the thickness m ($\mu$m) of the fine-particle-containing layer, the average diameter r ($\mu$m) of the fine particles and the thickness n ($\mu$m) of the color ink layer is represented as $n \geqq r \geqq m$, the separation of the color ink layer can be further improved, and a high-precision print image can be printed on a rough paper sheet as an image receptor.

In addition to the materials and ingredients used in the Examples, other materials and ingredients can be used in the present invention as set forth in the specification to obtain substantially the same results.

What is claimed is:

1. A thermal transfer recording medium comprising:

a foundation;

a release layer;

a fine-particle-containing layer containing a binder comprising a heat-meltable resin and fine particles dispersed therein; and a color ink layer containing a binder comprising a heat-meltable resin;

the release layer, the fine-particle-containing layer and the color ink layer being provided on one side of the foundation in that order;

wherein the relationship between the thickness m ($\mu$m) of the fine-particle-containing layer, the average diameter r ($\mu$m) of the fine particles and the thickness n ($\mu$m) of the color ink layer is represented as $n \geqq r \geqq m$.

2. The thermal transfer recording medium of claim 1, wherein the thickness m of the fine-particle-containing layer is from 0.2 to 3.0 $\mu$m, the thickness n of the color ink layer is from 1.0 to 3.0 $\mu$m, and the average diameter r of the fine particles is from 0.3 to 3.0 $\mu$m.

3. The thermal transfer recording medium of claim 1, wherein the content of the fine particles in the fine-particle-containing layer is from 5 to 80% by weight.

4. The thermal transfer recording medium of claim 1, wherein the binder of the fine-particle-containing layer contains not less than 80% by weight of the heat-meltable resin.

5. The thermal transfer recording medium of claim 1, wherein the binder of the color ink layer contains not less than 70% by weight of the heat-meltable resin.

* * * * *